United States Patent [19]

Wedrall

[11] 3,934,865

[45] Jan. 27, 1976

[54] UNDERWATER TIMER AND RELEASE DEVICE

[76] Inventor: Edwin J. Wedrall, 1170 N. Puente St., Brea, Calif. 92611

[22] Filed: Sept. 9, 1974

[21] Appl. No.: 504,338

Related U.S. Application Data

[62] Division of Ser. No. 421,856, Dec. 5, 1973.

[52] U.S. Cl. ..... 267/114; 200/34

[51] Int. Cl.[2] ..... F16F 5/00

[58] Field of Search ..... 267/114; 9/9, 8 R, 10; 188/298; 200/33, 34

[56] References Cited

UNITED STATES PATENTS

| | | | |
|---|---|---|---|
| 3,121,239 | 2/1964 | Cannon, Jr. | 9/9 |
| 3,332,390 | 7/1967 | Ashline | 9/9 |
| 3,484,090 | 12/1969 | Mahoney | 267/114 |

*Primary Examiner*—James B. Marbert

*Attorney, Agent, or Firm*—Francis X. Lo Jacono, Sr.

[57] ABSTRACT

An underwater timer and release device comprising a cylindrical housing sealed at its opposite ends and adapted to receive a slidable spring-loaded piston therein. The piston includes a metering orifice to provide a regulated flow of fluid from a secondary chamber to a primary chamber, thereby actuating a releasing means when the piston shaft is disengaged from a locking means and is allowed to operate. Releasably secured to the housing is a float marker, which rises to the surface of the water, having an interconnecting cord attached to the submerged housing. A one-way check valve is also disposed within the piston, whereby the fluid can be transferred back into the secondary chamber for reloading the release means.

1 Claim, 3 Drawing Figures

FIG. 1
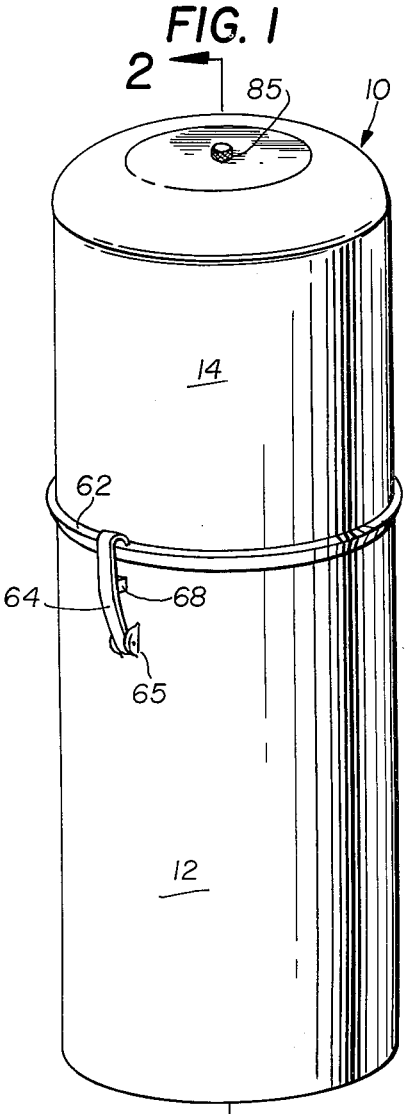
FIG. 2
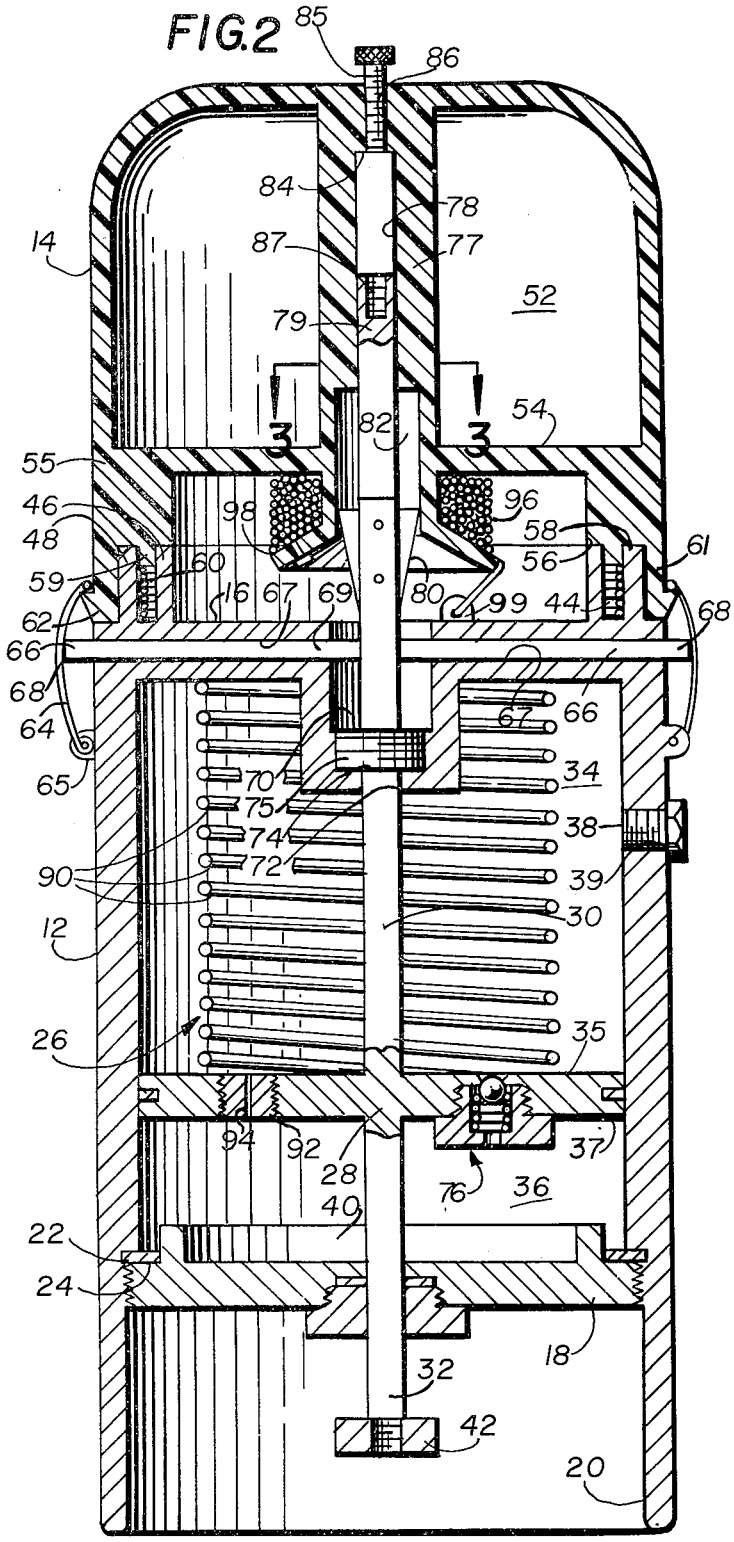
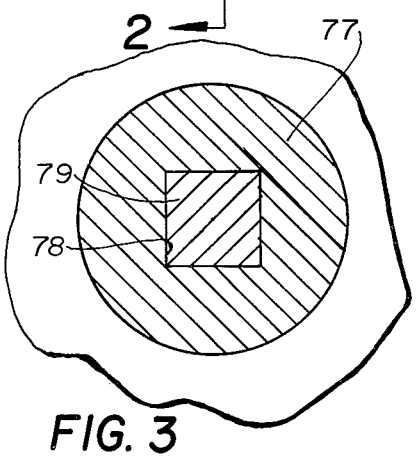
FIG. 3

UNDERWATER TIMER AND RELEASE DEVICE

This is a division of application Ser. No. 421,856 filed Dec. 5, 1973.

BACKGROUND

1. Field of the Invention

This invention relates generally to a timing and releasing device, and relates more particularly to a timing and releasing device adapted for use in underwater operations such as skin diving, and positioning and locating various subaqueous apparatuses where time marks are required.

2. Description of the Prior Art

As is well known in the art, various underwater marking devices have been proposed with timing and releasing means. However, these devices have yet to solve many of the still-existing problems.

One particular desire is to provide skin divers, deep-sea divers and like individuals, who either for sport or business spend considerable time submerged below the water, with a simple marking device that can be attached to the individual and which has a time-release mechanism incorporated therewith as an added safety feature.

There are various timing devices for use underwater, but they are generally made up of complicated mechanical elements that are not always reliable — particularly if they have been submerged and exposed to weathering, and the like, without being operated for any length of time. Thus, there is a chance that this type of device will become inoperable without the operator being aware — hence, creating a safety hazard, which is just what such a device is designed to eliminate.

There are also occasions when such marking devices are needed to mark various underwater locations or subaqueous apparatuses, including submerged oil structures.

Therefore, it is very necessary to provide a marking device with a positive release means having a timing device that is not affected by any adverse conditions.

There have been many instances when a diver becomes fascinated with his surroundings and forgets to check his time or air supply, and another diving fatality occurs. Hence, if a very simple positive timing device is attached to the divers and set to release a warning marker before it is too late, many lives could be saved.

SUMMARY

This invention provides a simple positive timing-and-releasing device, in combination with a buoyant mass or float that is easily recognizable when floating on the surface of a body of water, said invention comprising a cylindrical housing having an upper integral closed end and a lower removable end. Adapted to be slidably received within the housing is a piston having an elongated rod projecting outwardly from both sides of the piston, whereby the lower rod portion extends through the lower end and the upper portion of the rod extends through the upper closed end. With the piston so disposed, there is defined an upper and a lower chamber, the upper chamber being referred to as the primary chamber and the lower chamber being referred to as the secondary chamber.

Positioned within the primary chamber is a biasing spring whereby the piston is forced downwardly, forcing fluid in the secondary chamber to enter the primary chamber through a metering means, the metering means being disposed within the piston along with a check valve. The check valve allows the fluid to be transferred back to the secondary chamber when the device is to be reset.

Removably secured to the upper portion of the housing is a buoyant mass or float which is provided with a locking means in which the piston is held in an inactive position until the locking means is disengaged therefrom. The float is removably held in place by a releasing means operably disposed in the housing. The releasing means is actuated by an actuator cam which is affixed to the upper piston rod. As the rod moves downwardly with the piston, the cam contacts the releasing means whereby the float is allowed to separate from the housing and rise to the surface of the water by means of a cord being interconnected between the float and the submerged housing. Thus, the location and/or recovery of the apparatus, equipment, or diver, having the device attached thereto is readily accomplished.

OBJECTS AND ADVANTAGES

The present invention has for an important object the provision of a spring-actuated piston which incorporates a check valve and a metering means, for transferring of fluid from one chamber to another to activate a releasing means whereby a buoyant device is allowed to surface.

It is another object of the invention to provide an underwater timer and float device wherein the timing device comprises a metered orifice for a silent positive operation.

It is another object of the invention to provide an underwater timer and float device that incorporates a minimum number of parts or members, whereby the operation of said device can be relied upon at all times.

It is another object of the present invention to provide a device of this character that is relatively inexpensive to manufacture.

A further object of this invention is to provide a device of this character that is simple and rugged in construction, and has a relatively long-working life.

It is a further object of this invention to provide a device of this character that is easy to service and maintain, with the major working components sealed from adverse conditions.

Other characteristics, advantages and objects of this invention can be more readily appreciated from the following description and appended claims. When taken in conjunction with the accompanying drawings, this description forms a part of the specification wherein like references and characters designate corresponding parts in several views.

DESCRIPTION OF THE DRAWINGS

Referring more particularly to the accompanying drawings, which are for illustrative purposes only:

FIG. 1 is a perspective view of the overall invention;

FIG. 2 is a vertical cross-sectional view taken along line 2—2 of FIG. 1; and FIG. 3 is an enlarged cross sectional view taken along line 3—3 of FIG. 2.

DESCRIPTION OF THE PREFERRED EMBODIMENT

Referring to the drawing and more particularly to FIG. 1, there is shown a timed release and marking device, generally indicated at 10, comprising a cylindrical housing 12 having a buoyant mass or float 14 removably attached to the upper end of said housing. As illustrated, this device is designed for use while submerged under a body of water; however, various elements therein, as will be hereinafter described, can be incorporated for other uses.

Thus, this device as illustrated and described is generally associated with underwater activities such as skin diving, deep-sea commercial diving, underwater oil drilling, etc.

The cylindrical housing 12 comprises an upper, integral, closed end wall 16 and a lower removable wall 18, said wall 18 being threadably received within the extended enlarged opening 20 having an annular shoulder 22 to provide a stop means, whereby upper wall 16 and said lower wall 18 are spaced apart at a predetermined distance. Disposed between said wall 18 and shoulder 22 is a sealing ring 24, thereby providing a sealed compartment, generally indicated at 26 as defined by housing 12, and upper and lower walls 16 and 18, respectively.

Within compartment 26 there is slidably disposed a piston 28 having an elongated piston rod 30 extending upwardly through the integral wall 16, and a lower downwardly-extending rod 32 extending through the central portion of end wall 18.

Since the piston is disposed within compartment 26, there are established two interconnected chambers — that is, a primary chamber 34 located between the upper surface 35 of the piston 28 and the upper end wall 16, and a secondary chamber 36 positioned between the lower piston surface 37 and the lower end wall 18. Received within these chambers and sealed therein is a hydraulic fluid which is inserted within the compartment 26 through opening 38 which is adapted to receive a threaded plug 39.

The filling of the compartment 26 is accomplished by positioning the piston 28 to its lowermost stroke, which is generally when piston surface 37 abuts against an annular upstanding rib 40 which is formed as an integral part of the lower end wall 18. Hence, the piston is pulled to the above-described position by means of knob 42 secured to the extended rod 32, at which time the primary chamber is provided with its largest volume area to receive the necessary amount of fluid. The plug 39 is replaced, thereby sealing the fluid within the housing 12. A further detailed description of the movement of the slidable piston will hereinafter be given.

Referring now, in more detail, to the upper end of the housing 12, there is included a means for releasably securing the float marker 14 from said housing. Referring more particularly to FIG. 2, the upper integral wall 16 is adapted with an annular channel 44 defined by a pair of juxtaposed, circular, upstanding partitions 46 and 48, respectively. These partitions correspond to the bottom annular configuration of the float 12, wherein said float comprises a dome-like structural wall forming a hollow sealed compartment 52 which provides the necessary buoyant condition, said compartment 52 being sealed by a flat wall 54.

Extending downwardly from the dome structured wall is an enlarged framework 55, said framework terminating in the bottom annular configuration adapted to be received in channel 44. To be more specific, the annular configuration comprises a pair of grooves 56 and 58 in which are received partitions 46 and 48, respectively, said grooves being separated by an annular ring member 59 which protrudes downwardly into channel 44. However, ring member 59 is only partially inserted therein, thereby leaving a void in which there is disposed a coil spring 60 having an upward biasing force. Further, the lower configuration includes an elongated lip member 61 which superposes over annular partition 48, said lip being adapted around its periphery with a radially extended shoulder 62 to which a portion of the releasable securing means is attached.

Accordingly, the buoyant mass or float 14 is positioned on the upper portion of the housing 12 and held in place by said releasing means which comprises a pair of finger clamps 64, each being diametrically disposed to the other and pivotally attached at 65 to the housing 12. The finger clamps are generally made of light spring-like metal which is allowed to snap over the radial shoulder 62 of the float 14, thereby holding said float thereon until so released. The release thereof is accomplished by clamp-release slide bars 66, said bars being slidably supported within horizontal elongated bores 67. Each bar is so disposed so that its outer ends 68 are positioned adjacent each finger clamp, as seen in FIG. 2. The opposite ends 69 of the bars terminate in a cavity 70 formed in the central portion of the upper end wall 16. This cavity receives rod 30 through opening 72 which is sealed by washer 74 and washer nut 75; hence, fluid from compartment 26 cannot be lost therethrough.

After the float 14 is secured to the housing, the piston 28 is forced upwardly in the cylinder compartment 26, thereby forcing fluid from said primary chamber 34 into the secondary chamber 36 by means of a check valve, generally indicated at 76, positioned within the piston 28. Thus, the valve is adapted to permit fluid flow in one direction only, and that being as described.

As the piston moves upwardly, its extended rod 30 is received within a central core member 77 having a multisided bore 78; and portion 79 of the rod 30 is provided with a matching configuration (see FIG. 3), the rod and piston thus being prevented from rotating within the housing 12. Further, the rod is adapted with a cam-release actuator 80 which is slidably received within an enlarged bore 82 disposed at the lower end of the core member 77. The free end portion 79 abuts against wall 84 when piston 28 is positioned in its uppermost stroke and is secured in said position by a locking means, illustrated in the drawings as a screw 85, threadably received within aperture 86 disposed in the top of float 14 for reception within threaded bore 87 of rod portion 79. When said piston is so positioned, the locking means prevents downward movement of piston 28, which is being biased downwardly by coil spring 90 disposed within said primary chamber 34.

Thus, when screw 85 is disengaged from rod 30, spring 90 forces piston 28 downwardly at a predetermined rate by a fluid-flow regulating means shown as a plug 92 mounted in piston 28, wherein said plug is provided with a metered orifice 94 which allows the fluid to pass from chamber 36 back into chamber 34. Thus, the rate of movement of piston 28 depends on the size of the orifice 94.

Further, however, before the piston reaches its total downward stroke, said cam-release actuator 80 engages ends 69 of the slide bars 66, forcing them outwardly against said adjacent spring fingers 64, thereby releasing said fingers from their clamped mode, whereby the float member 14 is biased away from said housing 12 by spring 60 disposed in channel 44. Since the float is buoyant, it rises rapidly to the surface of the water and, as it does so, a connecting line 96 is permitted to unroll from reel 98. Line 96 is affixed at one end to the reel 98 which is part of the float 14; and the opposite end of line 96 is secured to the housing 12 as at 99.

Hence, whatever the housing 12 is attached to when totally submerged can be readily located by means of the float 14.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. A fluid controlled timing device, comprising:

a cylindrical housing having an upper wall and a removable lower end wall, wherein there is defined a compartment:

a slidable piston head disposed within said compartment;

a primary chamber formed between said upper wall and said piston head;

a secondary chamber formed between said lower end wall and said piston head;

a biasing means disposed within said primary chamber, whereby said piston head is biased in the direction of said secondary chamber;

a one-way check valve positioned within said piston head, whereby fluid is allowed to pass from the primary chamber into said secondary chamber;

a fluid-flow-regulating means disposed in said piston, whereby fluid flow from said secondary chamber to said primary chamber is metered therethrough at a predetermined rate for controlled movement of said piston;

wherein said fluid-flow-regulating means comprises a plug disposed in said piston head having a orifice extending therethrough, providing a communicating passage between said primary and secondary chambers, whereby said flow of fluid is predetermined by the size of said passage;

at least one rod attached to said piston head and extending outwardly from said housing; and a hydraulic fluid is disposed within said cylindrical housing, and wherein said cylindrical housing includes a plug removably received within an opening positioned in said housing.

* * * * *